US009115580B2

(12) United States Patent
Mazyar et al.

(10) Patent No.: US 9,115,580 B2
(45) Date of Patent: Aug. 25, 2015

(54) CELLULAR PUMP

(75) Inventors: Oleg A. Mazyar, Houston, TX (US); Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 828 days.

(21) Appl. No.: 13/347,920

(22) Filed: Jan. 11, 2012

(65) Prior Publication Data

US 2013/0014944 A1 Jan. 17, 2013

Related U.S. Application Data

(63) Continuation-in-part of application No. 12/860,305, filed on Aug. 20, 2010, now Pat. No. 8,616,272.

(51) Int. Cl.
*E21B 43/38* (2006.01)

(52) U.S. Cl.
CPC ..... *E21B 43/385* (2013.01); *E21B 43/38* (2013.01)

(58) Field of Classification Search
CPC ..... E21B 43/385; E21B 43/38
See application file for complete search history.

(56) References Cited

U.S. PATENT DOCUMENTS

| | | | | |
|---|---|---|---|---|
| 3,223,240 | A | 12/1965 | Muller | |
| 3,568,842 | A | 3/1971 | Bozek | |
| 3,617,551 | A * | 11/1971 | Johnston et al. | 210/649 |
| 3,631,654 | A | 1/1972 | Riely et al. | |
| 3,959,191 | A | 5/1976 | Kehr et al. | |
| 4,237,237 | A | 12/1980 | Jarre et al. | |
| 4,279,757 | A * | 7/1981 | DeBeuckelaer et al. | 210/671 |
| 4,356,090 | A * | 10/1982 | Tran | 210/350 |
| 5,860,937 | A | 1/1999 | Cohen | |
| 6,375,854 | B2 | 4/2002 | Beplate | |
| 6,583,194 | B2 | 6/2003 | Sendijarevic | |
| 6,747,068 | B2 | 6/2004 | Kelly | |
| 7,527,738 | B2 | 5/2009 | Gonzalez et al. | |
| 7,823,635 | B2 | 11/2010 | Wright et al. | |
| 7,854,261 | B2 | 12/2010 | Woie et al. | |
| 8,262,909 | B2 | 9/2012 | Angelescu et al. | |
| 2002/0189807 | A1 | 12/2002 | Emanuele et al. | |
| 2008/0193738 | A1 * | 8/2008 | Hensley et al. | 428/308.4 |

OTHER PUBLICATIONS

Matthews et al. "Application of Downhole Oil/Water Separation Systems in the Alliance Field," SPE Health, Safety and Environment in Oil and Gas Exploration and Production Conference, Jun. 9-12, 1996, New Orleans, Louisiana. [Abstract and Introduction Only].

Peachey, B.R. and C. M. Matthews. "Downhole Oil/Water Separator Development," Journal of Canadian Petroleum Technology, vol. 33, No. 7, Jul. 1994. [Abstract and Introduction Only].

(Continued)

*Primary Examiner* — Giovanna C Wright
(74) *Attorney, Agent, or Firm* — Cantor Colburn LLP

(57) ABSTRACT

A downhole fluid separation assembly, including a body having greater affinity to a first fluid than a second fluid. The body is operatively arranged with openings for enabling fluid flow therethrough. A member is included that is movable with respect to the body and operatively arranged to compress a section of the body adjacent to the member for urging fluid out of the body and toward a target location. The body is configured to expand when not adjacent to the member for enabling fluid to reenter the body. A method of separating fluids is also included.

19 Claims, 6 Drawing Sheets

(56) References Cited

OTHER PUBLICATIONS

Sartomer. "Product Bulletin: Hydroxyl Terminated Polybutadiene Resins and Derivatives—Poly bd® and Krasol®" Jun. 2007.

Veil et al. "Feasibility Evaluation of Downhole Oil/Water Separator (DOWS) Technology," U.S. Department of Energy, Office of Fossil Energy, National Petroleum Technology Office, 1998/ [Summary Only].

* cited by examiner

CELLULAR PUMP

CROSS-REFERENCE TO RELATED APPLICATIONS

This application is a continuation-in-part of U.S. Non-provisional application Ser. No. 12/860,305 filed on Aug. 20, 2010. The parent application is incorporated by reference herein in its entirety.

BACKGROUND

In the downhole drilling and completions industry, desired fluids, e.g., hydrocarbons, are often held in reservoirs or formations containing fluid stores composed also of undesirable fluids, e.g., water. In some cases the volume of water is several times that of the volume of hydrocarbons in a reservoir. Production of fluids from such reservoirs then roughly requires the transport and associated wear of several times the fluid that is actually desired, the fluids must be separated, and large quantities of the undesirable fluid dealt with. As a result, the industry well receives advances in fluid separation, particularly downhole fluid separation.

SUMMARY

A downhole fluid separation assembly including a body having greater affinity to a first fluid than a second fluid, the body operatively arranged with openings for enabling fluid flow therethrough, and a member movable with respect to the body and operatively arranged to compress a section of the body adjacent to the member for urging fluid out of the body and toward a target location, the body configured to expand when not adjacent to the member for enabling fluid to reenter the body.

A method of separating fluids including exposing a body to a fluid mixture containing a first fluid and a second fluid, the body having openings therein for enabling fluid flow therethrough, and the body having a greater affinity for the first fluid than the second fluid, alternatingly compressing sections of the body for urging fluid out of the openings in the body toward a target location, and alternatingly expanding sections of the body for enabling fluid to flow into the body.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
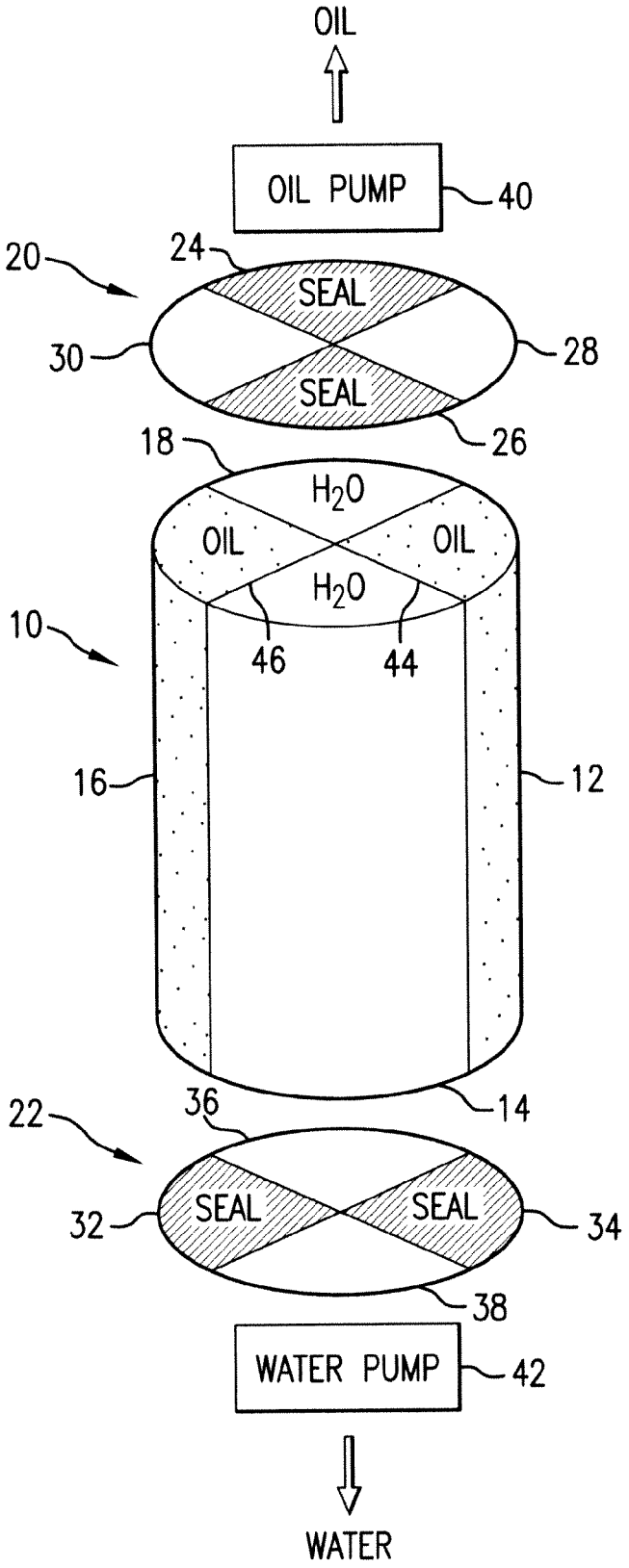
FIG. 1 is a schematic composite view of a number of embodiments of the arrangement disclosed herein.

Referring to FIG. 1, attention is first directed to a body 10. Body 10 is a schematically illustrated concept comprising a configuration that promotes oil migration in a distinct pathway from water migration through specific material of the body 10. In one embodiment the differential fluid migration is in two directions while in other embodiments the fluid migration may be in the same direction but with construction that conveys the distinct fluids to distinct pathways.

Considering a first exemplary embodiment, the body 10 is cylindrical as shown. It will be appreciated that any appropriate geometry is possible such as oval, square, rectangular, trapezoidal, etc. The geometry of the cross section of the body 10 is, in general, related to the cross section of a borehole in a formation in which the body is positioned or the cross section of a completion member and in which the body is positioned. This is especially true where the body comprises a shape memory material and therefore will conform to the shape of the "container" (e.g. open hole or completion) in which it is disposed. In one embodiment, the material of the body is a polyurethane foam material that may have shape memory properties that can be harnessed in some embodiments to cause the body to contact and provide support to a formation wall.

Whether or not the material itself possesses shape memory characteristics, it will necessarily include portions having differential affinities. For example, one portion of the body 10 may have an affinity for a first fluid while another portion of the body 10 might have affinity for another fluid. In some embodiments one portion or portions will exhibit hydrophobicity while another portion or portions will exhibit hydrophilicity. In the illustrated embodiment the body 10 comprises portions 12, 14, 16 and 18 where portions 12 and 16 have an affinity to a particular fluid type, for example exhibit hydrophobic properties and portions 14 and 18 have an affinity for a different type of fluid, for example exhibit hydrophilic properties. It is to be understood that while the illustration contains 4 portions, more or fewer are contemplated. For example, there may be a single hydrophobic (or other type affinity) portion and one or more hydrophilic (or other type affinity) portions or a single hydrophilic (or other type affinity) portion and one or more hydrophobic (or other type affinity) portions. There also may be multiple portions of each type ranging from two to a number bounded only by practicality with respect to producing the body 10. Hydrophilic materials can be acquired commercially from many sources such as Rynel, Inc., Carwild Corp., Filtrona Porous Technologies, Foamex Innovations, etc. and Hydroxyl Terminated Polybutadiene, which is a polyol component of a hydrophobic polyurethane foam may be commercially acquired from such as Sartomer Company Inc., etc. Hydrophobic foam useful for the purposes disclosed herein, can be created from the Hydroxyl Terminated Polybutadiene by mixing the same with polyisocyanates and water (a foaming agent).

In one embodiment, and still referring to FIG. 1, a seal element 20 and a seal element 22 may each comprise a single member or a collection of pieces that form the member, or even may be separate pieces that are not connected to one another, is positioned at one or both ends of the body 10. The seal element 20 at either end is configured to prevent fluid migration from that end of body 10 for at least one of the fluids handled by body 10. Using FIG. 1 as an example, the seal 20 includes four quadrants, 24, 26, 28 and 30. 24 and 26 are aligned with the hydrophilic portions 14 and 18 of body 10 and hence are intended to prevent water from moving past. It will be appreciated that the portions 24 and 26 are at an uphole end of body 10 to prevent water from moving uphole. Quadrants 28 and 30 on the other hand are aligned with the hydrophobic portions 12 and 16 of the body 10 and are configured to allow fluid passage, i.e. these portions do not act as seals against the fluid collected in the hydrophobic portions of the body 10. As such, fluid such as oil that has been moved through the portions 12 and 16 of the body 10 is allowed to continue toward a target location such as uphole, and fluid such as water that has been moved through portions 14 and 18 is prevented from continuing uphole but rather is stopped in body 10. In one embodiment the seal 20 is used without a complementary seal 22 but in another embodiment both seals 20 and 22 are employed. Where both seals 20 and 22 are employed, the seal 22 will have an opposite orientation to that of seal 20. In the illustrated example, portions 32 and 34 are impermeable and are aligned with the hydrophobic portions 12 and 16 of body 10 to prevent the migration of fluid such as oil in a nondesired direction such as toward the bottom of a well, and portions 36 and 38 are permeable and aligned with portions 14 and 18 of body 10 to allow fluid such as water to continue to move in a direction that does not interfere with the purpose of the well. In the illustrated case this would be in a downhole direction. Each of these directed fluid movement configurations can be augmented with pumps 40 and 42 that will preferentially move whatever fluid they are fed in a particular direction. Because the fluid fed to the pumps will be the fluid that is desired to move in a particular direction and which has been segregated by the body 10, the goals of the arrangement are enhanced. In the illustrated embodiment, oil is segregated by body 10 and ferried in an uphole direction to pump 40 and water is segregated by the body 10 and ferried in a downhole direction to pump 42. The arrangement concentrated production of desirable fluids while avoiding the production of undesirable fluids thereby significantly improving efficiency and productivity.

It is further to be appreciated that in embodiments hereof, interportional surfaces 44 and 46 will be treated so that fluid is prevented from migrating across that interportional surface. Seals that are impermeable to polar and nonpolar fluids are contemplated such as rubber, nitrile, and other similar materials known to the downhole industry to be capable of providing impermeability.

The aforementioned oil and water migration properties can be used for water-oil separation in other embodiments utilizing similar bodies, e.g. foams that are hydrophobic, hydrophilic, etc. For example, in the embodiment of FIG. 2, an assembly 50 enables a combination of water and oil or other fluids to be separated and at least one of the fluids to be pumped, ferried, migrated, delivered, or otherwise directed to a target location.

The assembly 50 includes a body 52 that is formed from a media or material having a plurality of pores, holes, openings, spaces, orifices, cells, etc. therein (generally "openings" for ease in discussion). For example, in one embodiment, the body 52 is an open cell foam, e.g., a polyurethane foam having shape memory properties, as mentioned above, although other foams, polymers, or materials could be used. The body 52 could be formed from a single piece, or could be formed for a plurality of pieces, e.g., blocks, pellets, beads, etc. The openings in the body 52 enable fluids absorbed by or taken into the body 52 to travel or migrate through the body 52. For example, the openings may be arranged for promoting capillary action or wicking of the fluid into sections of the body 52 less saturated with, or relatively devoid of, the fluid due to surface tension of the fluid, adhesive forces between the fluid and the walls of the openings of the body 52, etc. With respect to the embodiment of FIG. 2, the fluid migrates from a fluid supply 54 toward a target location 56, although other arrangements are possible. In one embodiment, the fluid supply 54 is located in a formation or reservoir within the earth or an annulus between the assembly 50 and a borehole wall and the target location is located within a tubular string, e.g., a production tubular string of which the assembly 50 is a part.

The fluid supply 54 may contain any mixture of fluid components. In general, the body 52 has an affinity toward at least one of the fluid components in the fluid supply 54 such that migration of that fluid component through the body 52 is favored over at least one other fluid component. In this way, the properties of the body 52 can be set such that one fluid, e.g., oil, will more readily flow through the body 52 than another fluid, e.g., water. Under relatively high pressures, fluids may be forced through the body 52 with less regard to the affinity of the body 52 so it may be desired in such embodiments to pressurize the target location 56 so that the affinity of the body 52 sufficiently enables impedance of one fluid therethrough.

In one embodiment, a mixture of oil and water is found downhole and the production of oil is desired. Thus, by modifying the hydrophobicity of the body 52 to a sufficient level, migration of water through the body 52 can be restricted, prohibited, prevented, or otherwise impeded. Alternatively, one could modify the oleophilic properties of the body 52 to promote, assist, or encourage oil migration therethrough, although oleophilicity generally corresponds to hydrophobicity and vice-versa. Oppositely, the material of the body 52 could be hydrophilic and/or oleophobic for promoting the flow of water therethrough while impeding the flow of oil.

A piston or member 58 is movably arranged with the body 52 to further assist in the migration of the fluid from the supply 54 to the target location 56. Specifically, the piston 58 is configured to deform, e.g., compress, sections of the body 52 adjacent to the piston 58. That is, the section of the body 52 radially adjacent to the piston 58 will be displaced by the piston 58, thereby compressing the body 52, e.g., against a housing or shroud 60. For example, in FIG. 2 a section 62 of the body 52 is compressed by the piston 58 while a section 63 of the body 52 is not. The shroud 60 is provided in some embodiments for adding rigidity to the body 52, acting as a wall or stop against which the body 52 can be compressed by the piston 58, etc. The shroud 60 could be a sheet, mesh, tubular, etc. having slots, slits, openings, holes, perforations, etc. therein for enabling the fluid to pass therethrough. In some embodiments, the shroud 60 may not be included and the piston 58 would compress the body 52 against some other member, such as a wall of a borehole.

Figure 2:
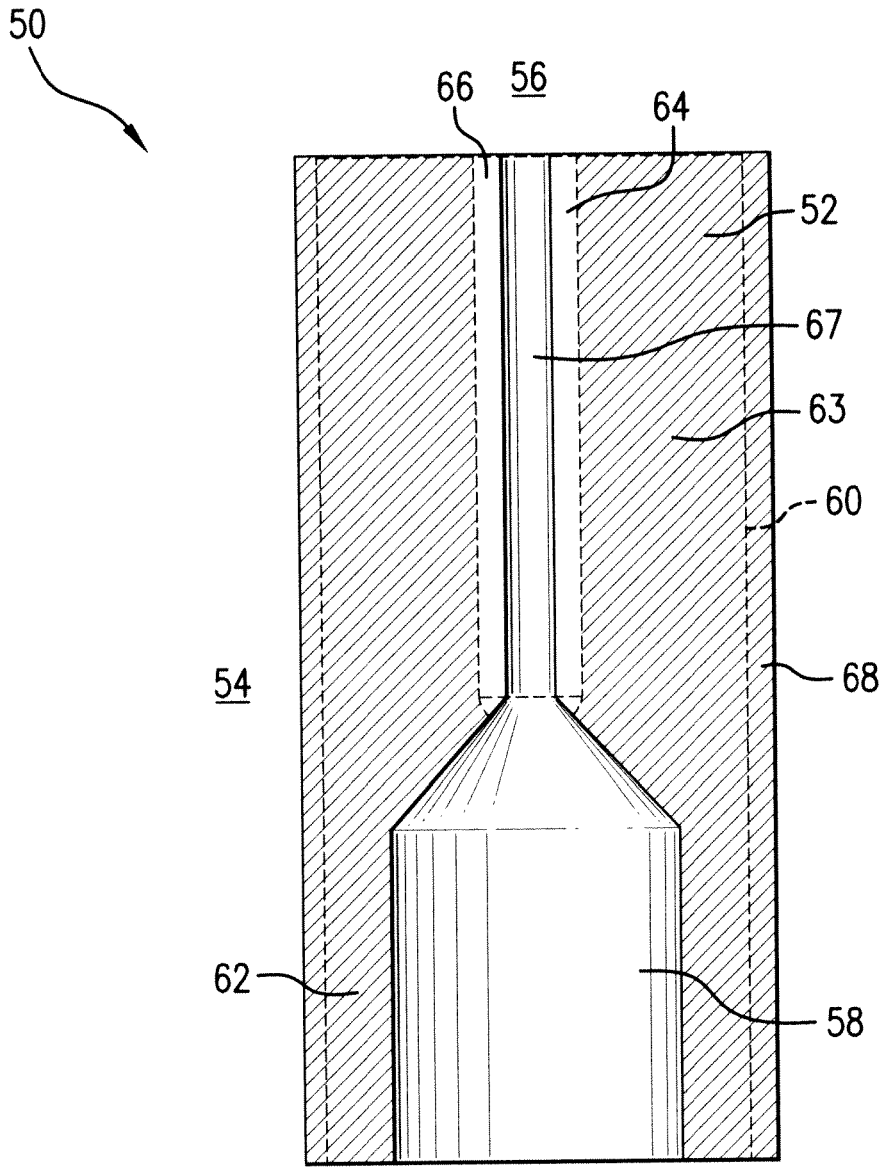
FIG. 2 is a schematic view of a fluid separation assembly including an integrated pump.

As the piston 58 moves relative to the body 52, the section that is compressed by the piston 58 changes accordingly, such that reciprocation or movement of the piston 58 results in sections of the body 52 to be alternatingly compressed and expanded. The piston 58 could reciprocate or move at a constant speed, intermittently with pauses at the end of each stroke, faster or slower in the direction toward the target location 56 (which may, e.g., enable more efficient extraction of the fluid), faster or slower in the direction opposite the target location 56 (which may, e.g., enable the rate of expansion of the body 52 to be tuned for aiding in capillary action of the fluid), etc. In this way, for example, fluid contained within the openings of the body 52 is forced out as the openings of the body 52 are compressed by the piston 58. In the embodiment of FIG. 2, a support 64 is included with the piston 58 for creating a void 66 between the support 64 and a rod 67 for the piston 58. The support 64 could be a sheet, tubular, mesh, etc. including perforations, openings, holes, orifices, etc. for enabling the passage of the fluid from the body 52 into the void 66. Thus, as the piston 58 moves into adjacency with a fluid-filled section of the body 52 and thereby compresses that section, the fluid previously held therein is forced into the void 66. The void 66 is in fluid communication with the target location 56 such that actuation of the piston 58 also acts to pump the fluid from the body 52 and/or the void 66 toward the target location 56.

Opposite to the above, as the piston 58 moves away from a section of the body 52 and that section is allowed to expand, the openings of the body 52 will enlarge, thereby drawing in more fluid, e.g., as a result of capillary action or wicking. This expansion and refilling with fluid primes the body 52 for the above described fluid extraction, e.g., into the void 66, to be repeated as necessary.

It is to be appreciated in view of the above that although the piston 58 is shown radially disposed with the body 52, such that sections radially adjacent the piston 58 are compressed, other orientations are possible. For example, in some embodiments the piston 58 may be positioned relative to the body 52 other than radially inwardly and the movement of the piston 58 may be other than axial. For example, the piston 58 could be replaced with some other member movable relative to the body 52 for squeezing or forcing fluid out of the body, such as a plurality of fingers, inflatable elements, rollers, etc., that are arranged to activate for compressing an increasing amount or alternating sections of the body 52 to direct fluid in the desired direction of flow.

In addition to the aforementioned uses, the assembly 50 may also be used as a sand screen or other filter for particulate matter. That is, although permitting fluid flow therethrough, the porosity of the body 52 and/or the size of the openings of the body 52 could be set to prohibit the passage of solids, e.g., sand. In some embodiments, the body 52 could be arranged to expand inwardly, outwardly, etc., in order to contact a radially disposed feature such as a tubular or borehole wall. By expanding in such a manner in order to contact a borehole wall, for example, the assembly 50 can be used as a conformable filter or sand screen. The body 52 could comprise a swellable material (e.g., swelling when absorbing a specific fluid), have shape memory properties enabling it to revert to a different shape or size (e.g., upon reaching or exceeding a transition temperature), etc. In embodiments including the shroud 60, a layer 68 of the body 52 may extend on the opposite side of the shroud 60 for enabling the previously mentioned expansion to occur. The layer 68 could be formed as a separate component or integrally with the rest of the body 52, such as by forming the body 52 in a mold that contains the shroud 60.

Figure 3:
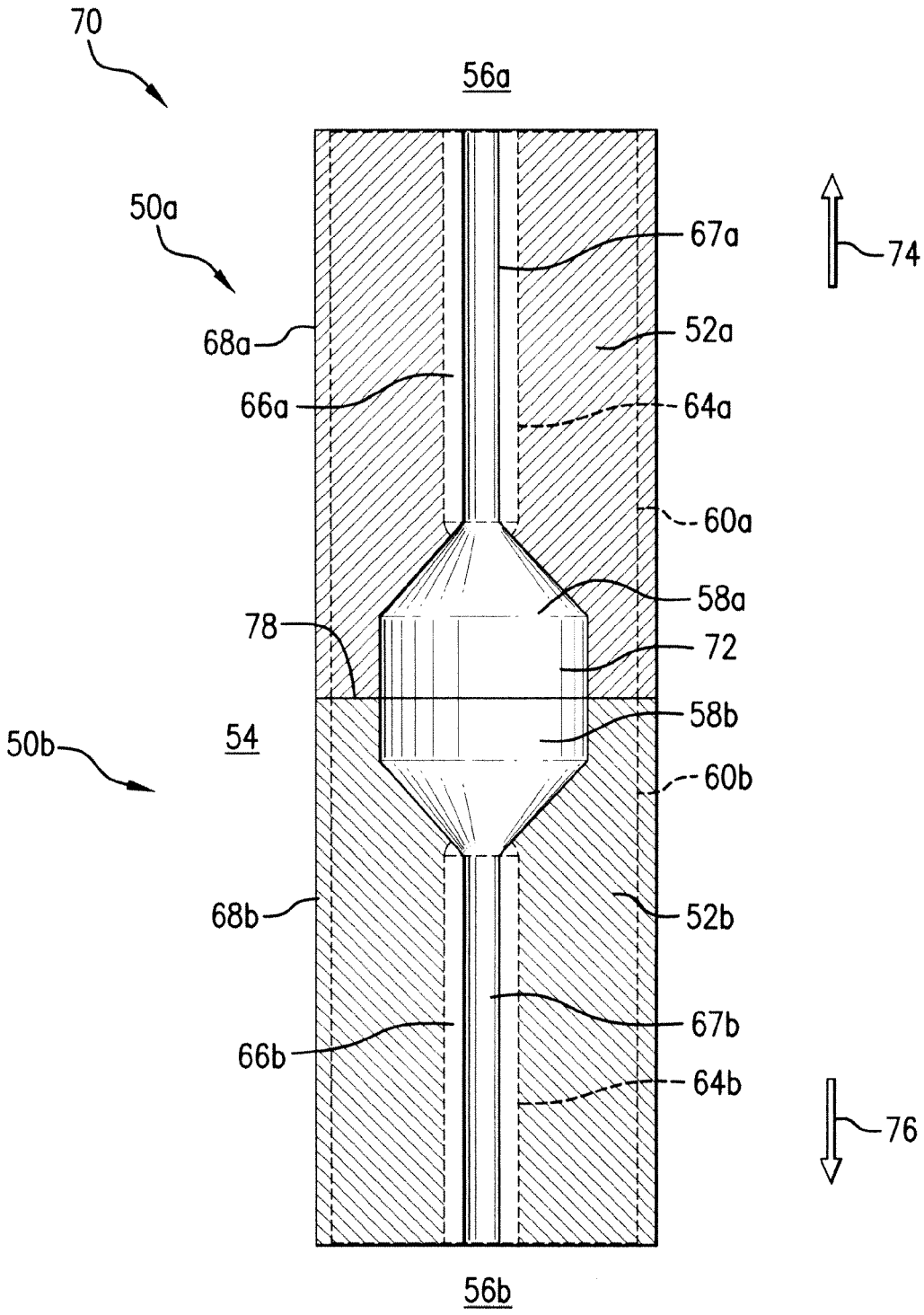
FIG. 3 is a schematic view of a fluid separation assembly including two materials of different fluid affinities and an integrated pump.

A system 70 is shown in FIG. 3 having two subassemblies 50*a* and 50*b*. The subassemblies 50*a* and 50*b* each substantially resemble the assembly 50 described above, with the alphabetic modifiers 'a' and 'b' used only for the sake of discussion in order to distinguish between the subassemblies 50*a* and 50*b* and their components. That is, all previous descriptions of components having reference numerals not including the alphabetic modifiers are generally applicable to all corresponding components in FIG. 3 having the modifiers 'a' and 'b', unless otherwise noted. Thus, a description of many of the components of the subassemblies 50*a* and 50*b* is not repeated, as their components are structured and operate similarly to the above.

The subassemblies 50*a* and 50*b*, in addition to each resembling the assembly 50 as noted above, are arranged in FIG. 3 as essentially mirror images of each other. A piston or other movable member 72 is disposed and movable between the two subassemblies 50*a* and 50*b*. The piston 72 generally resembles the piston 58 or a double-sided version thereof, e.g., including piston faces 58*a* and 58*b*. Furthermore, the piston 72 operates as described with respect to the piston 58 with the exception that the piston 72 acts to alternatingly compress and enable expansion of both the subassemblies 50*a* and 50*b*.

An advantage of using the two assemblies 50*a* and 50*b* over the assembly 50 alone is that one of the two subassemblies, e.g., the assembly 50*a*, can be set having an affinity to a first fluid, while the second of the two subassemblies, e.g., the assembly 50*b*, can be set having an affinity to a second fluid. For example, the body 52*a* could be hydrophobic, while the 52*b* is hydrophilic (or oleophilic/olephobic, etc.). Alternatively stated, the bodies 52*a* and 52*b* of the two subassemblies 50*a* and 50*b* act as the above-described portions (i.e., portions 12, 14, 16, 18) in the body 10 of FIG. 1 that had different fluid affinities. Thus, e.g., when the piston 72 is moved in a first direction, e.g., as indicated by an arrow 74, a first fluid (e.g., oil if the body 52*a* is hydrophobic or has an affinity to oil) is pumped in the first direction by compressing the body 52*a*, while a second fluid (e.g., water if the body 52*b* is hydrophilic or has an affinity to water) is pumped in a second direction, e.g., as indicated by an arrow 76, by compressing the body 52*b*. Thus, while the body 52*a* is being compressed by the piston 72, the body 52*b* is expanding and refilling with fluid and vice-versa for repeating the pumping cycle as desired. In this way, fluid separation, such as oil-water separation, is efficiently accomplishable with each of the two fluid components being pumped simultaneously to different locations or in different directions with a single piston or other movable member.

In one embodiment, a seal element 78 is included at the interface between the two bodies 52*a* and 52*b*. The seal element 78 could take the form, e.g., of an expandable elastomeric seal or non-permeable coating or layer on or between the bodies 52*a* and/or 52*b* for preventing the piston 72 from undesirably forcing fluid from one body 52*a* and 52*b* into the other.

Figure 4:
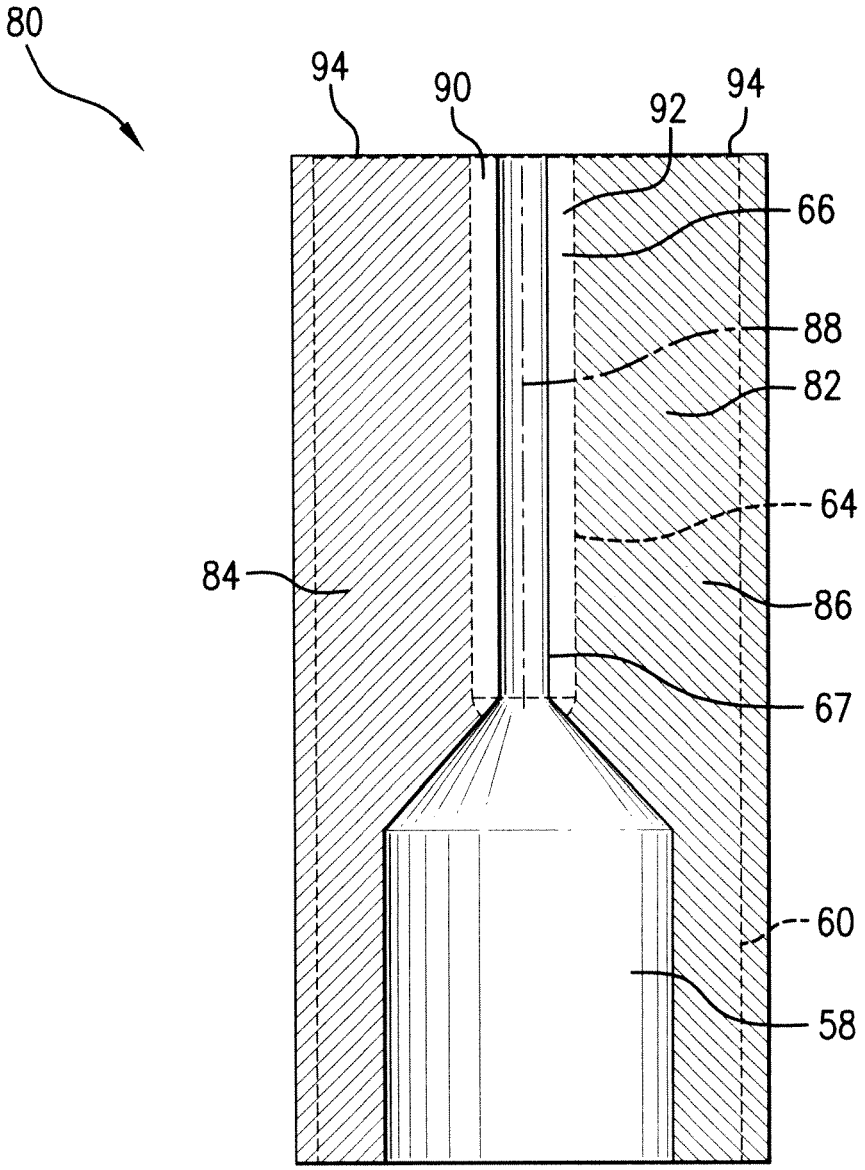
FIG. 4 is a schematic view of another fluid separation assembly including two materials of different fluid affinities and an integrated pump.

Another embodiment is shown in FIG. 4, namely, an assembly 80. In effect, the assembly 80 resembles a combination of the embodiments of FIGS. 1 and 2. Namely, a body 82 of the assembly 80 at least partially resembles both the body 52 (e.g., in that it includes the piston 58, shroud 60, support 64, etc. mounted therein) and the body 10 (e.g., in that the body 82 is split into multiple portions of material having different affinities, resembling the portions 12, 14, 16, and 18). In FIG. 4, only two portions, namely, portions 84 and 86 are shown, although any number of portions could be utilized.

In order to prevent the first and second fluids from commingling, the assembly 80 is arranged with fins 88 extending across the void 66, between the support 64 and the rod 67, at each intersection of portions of dissimilar materials. If the portions 84 and 86 are each arranged semi-circularly to form the body 82 as a hollow cylinder, and the cross-sectional view of FIG. 4 is taken perpendicularly to the boundary or intersection between the portions 84 and 86, then the fin 88 can be seen in hidden lines located behind the rod 67 for the piston 58 (another fin, spaced 180 degrees from the fin 88 would be included at the other boundary between the portions 84 and 86).

In various embodiments, the number of fins 88 is equal to the number of adjacent portions that form the body, or more specifically, to the number of intersections or boundaries between such portions. For example, in embodiments in which the body 82 is made from four portions (e.g., resembling the body 10 as shown in FIG. 1), one fin 88 would be included at each intersection or boundary between the portions, for a total of four fins spaced ninety degrees apart. Additionally, seal elements or non-permeable layers or coatings could be included in the body 82 itself at the boundaries or intersections between the various portions of the body. In this way, the void 66 can be split into multiple compartments, e.g., compartments 90 and 92, for each of the fluid components. The compartments 90 and 92 can be directed to different target locations via different pathways. For example, there could be two target locations with the compartment 90 in fluid communication with a surface location for enabling production of oil, while the compartment 92 is in fluid communication with a downhole location for returning water back to the formation from which it came. Additionally, seals could be located at the ends of the bodies 82, e.g., resembling a combination of the seal assemblies 20 and 22, in order to prevent unwanted fluid from flowing out of the body 82. For example, by placing seals 94 at the ends of the portions 82 and 84, the pumped fluids will be forced into their respective compartments 90 and 92.

It is to be appreciated that combinations of any elements from the embodiments described herein are of course possible, e.g., as represented by the embodiment of FIGS. 3 and 4 including elements from both FIGS. 1 and 2. Accordingly, the assemblies discussed herein are arrangeable for providing the benefits of a fluid separator, pump, and conformable sand screen, or any combination thereof.

In various embodiments, any combination of the bodies 10, 52, 52*a*, 52*b*, 82 and 84, or portions thereof could comprise nanoparticles for tailoring the properties of bodies. According to an embodiment, a body (e.g., one or more of the bodies 10, 52, 52*a*, 52*b*, 82 and 84) includes an open cell foam and nanoparticles disposed in the open cell foam. The nanoparticles can be exposed within pores of the open cell foam. Additionally, the nanoparticles can be disposed among the chains of a polymer contained in the open cell foam to be unexposed in the pores of the open cells. The open cell foam includes a base polymer and nanoparticles. The nanoparticles can be non-derivatized or derivatized to include chemical functional groups to increase wettability (e.g., hydrophobicity, hydrophilicity, etc.), dispersibility, reactivity, surface properties, compatibility, and other desirable properties. Combinations comprising derivatized and non-derivatized nanoparticles can also be used.

In an embodiment, the base polymer of the open cell foam is polyurethane. Polyurethane in general is a condensation product of a di- or polyisocyanate and a di- or polyhydroxy compound (also referred to as diol or polyol herein). A chain extender, for example, chain extenders based on di- or polyamines, alternatively or in addition to diols can be included in place of part of the diol charge to form the base polymer. The diol, polyol, diisocyanate, polyisocyanate, chain extender, and other species that react to form the base polymer are referred to collectively as reactive monomers.

Di- and polyhydroxy compounds can include, for example, diols and polyols having from 2 to 30 carbon atoms. Useful diols include glycols including oligomeric glycols having repeating alkyleneoxy units including di-, tri- and higher glycols, or polyglycols. Exemplary diols may include ethylene glycol, propylene glycol, trimethylene glycol, 1,3-butanediol, 1,4-butanediol, bishydroxymethyl cyclohexane, neopentylglycol, diethylene glycol, hexanediol, dipropylene glycol, tripropylene glycol, polypropylene glycol, triethylene glycol, polyethylene glycol, tetraethylene glycol, oligomeric and polymeric glycols such as polyethylene glycols, polypropylene glycols, polybutylene glycols, poly(ethylene-propylene)glycols, and the like. Combinations comprising at least one of the foregoing dihydroxy compounds can be used.

Exemplary suitable polyols include triols, for example glycerol, trimethylol propane, pentaerythritol, tris(2-hydroxyethyl)isocyanurate, and the like; tetrols such as dipentaerythritol; and other sugar alcohols such as inositol, myo-inositol, sorbitol, and the like. Combinations comprising at least one of the foregoing polyhydroxy compounds can be used.

Polyurethanes are typically prepared by the condensation of a diisocyanate with a diol. Aliphatic polyurethanes having at least two urethane moieties per repeating unit are useful, wherein the diisocyanate and diol used to prepare the polyurethane comprise divalent aliphatic groups that may be the same or different. The divalent aliphatic units can be C2 to C30, specifically C3 to C25, more specifically C4 to C20 alkylene groups, including straight chain alkylene, branched chain alkylene, cycloalkylene, heteroalkylene such as oxyalkylene (including polyetheralkylene), and the like. Exemplary aliphatic diradical groups include but are not limited to ethylene; 1,2- and 1,3-propylene; 1,2-, 1,3-, and 1,4-butylene; 1,5-pentamethylene; 1,3-(2,2-dimethyl)propylene; 1,6-hexamethylene; 1,8-octamethylene; 1,5-(2,2,4-trimethyl)pentylene, 1,9-nonamethylene; 1,6-(2,2,4-trimethyl)hexylene; 1,2-, 1,3-, and 1,4-cyclohexylene; 1,4-dimethylene cyclohexane; 1,11-undecamethylene; 1,12-dodecamethylene, and the like.

Monomeric diisocyanates may be used to prepare the polyurethane. The diisocyanate component may be a monomeric C4-20 aliphatic or C4-20 aromatic diisocyanate. Exemplary aliphatic diisocyanates include isophorone diisocyanate; dicyclohexylmethane-4,4'-diisocyanate; 1,4-tetramethylene diisocyanate; 1,5-pentamethylene diisocyanate; 1,6-hexamethylene diisocyanate; 1,7-heptamethylene diisocyanate; 1,8-octamethylene diisocyanate; 1,9-nonamethylene diisocyanate; 1,10-decamethylene diisocyanate; 2,2,4-trimethyl-1,5-pentamethylene diisocyanate; 2,2'-dimethyl-1,5-pentamethylene diisocyanate; 3-methoxy-1,6-hexamethylene diisocyanate; 3-butoxy-1,6-hexamethylene diisocyanate; ω,ω'-dipropylether diisocyanate; 1,4-cyclohexyl diisocyanate; 1,3-cyclohexyl diisocyanate; trimethylhexamethylene diisocyanate; and combinations comprising at least one of the foregoing.

Exemplary aromatic polyisocyanates include toluene diisocyanate, methylene bis-phenylisocyanate (diphenylmethane diisocyanate), methylene bis-cyclohexylisocyanate (hydrogenated MDI), naphthalene diisocyanate, and the like.

Polymeric or oligomeric diisocyanates can also or alternatively be used to prepare a polyurethane or a urethane- or urea-linked copolymer. Exemplary oligomeric or polymeric chains for the polymeric diisocyanates include polyurethanes, polyethers, polyester, polycarbonate, polyestercarbonates, and the like. In an embodiment, the polyisocyanate is a polymeric polyisocyanate, such as a polymer chain with terminal isocyanate groups. Useful polyisocyanates include those based on polyesters such as polyaliphatic esters including polylactones, polyarylate esters including copolymers of phthalates with phenols such as bisphenol A, dihydroxybenzenes, and the like; and poly(aliphatic-aromatic)esters such as ethylene terephthalate, butylene terephthalate, and the like.

A useful class of polyaliphatic ester-based diisocyanates is based on polylactones such as polybutyrolactones, polycaprolactones, and the like. Exemplary polyester-diisocyanates based on these polyesters include ADIPRENE® LFP 2950A and PP 1096, available from Chemtura, which are p-phenylene diisocyanate (PPDI)-terminated polycaprolactone prepolymers.

Alternatively or in addition to a dihydroxy compound, the diisocyanate may be condensed with a diamine, sometimes referred to as a chain extender. It will be appreciated that condensation of a diisocyanate with a dihydroxy compound produces a urethane linkage in the polymer backbone, whereas the condensation of diisocyanate with the diamine produces a urea linkage in the polymer backbone. Exemplary chain extenders include C4-30 diamines. The diamines may be aliphatic or aromatic. In a specific embodiment, useful diamines include aromatic diamines such as, for example, 4,4'-bis(aminophenyl)methane, 3,3'-dichloro-4,4'-diaminodiphenyl methane (also referred to as 4,4'-methylene-bis(o-chloroaniline), abbreviated MOCA), dimethylsulfidetoluene diamine (DADMT), and the like.

In addition to the polyurethane base polymer described above, the open cell foam includes nanoparticles. In an embodiment, the nanoparticles are non-derivatized, derivatized with functional groups, or a combination comprising at least one of the foregoing. Nanoparticles, from which the derivatized nanoparticles are formed, are generally particles having an average particle size, in at least one dimension, of less than one micrometer (μm). As used herein "average particle size" refers to the number average particle size based on the largest linear dimension of the particle (sometimes referred to as "diameter"). Particle size, including average, maximum, and minimum particle sizes, may be determined by an appropriate method of sizing particles such as, for example, static or dynamic light scattering (SLS or DLS) using a laser light source. Nanoparticles may include both particles having an average particle size of 250 nanometers (nm) or less, and particles having an average particle size of greater than 250 nm to less than 1 μm (sometimes referred in the art as "sub-micron sized" particles). In an embodiment, a nanoparticle may have an average particle size of about 0.5 nm to about 500 nm, specifically about 0.5 nm to about 250 nm, more specifically about 0.5 nm to about 150 nm, even more specifically about 0.5 nm to about 125 nm, and still more specifically about 1 nm to about 75 nm. The nanoparticles may be monodisperse, where all particles are of the same size with little variation, or polydisperse, where the particles have a range of sizes and are averaged. Generally, polydisperse nanoparticles are used. Nanoparticles of different average particle size may be used, and in this way, the particle size distribution of the nanoparticles may be unimodal (exhibiting a single distribution), bimodal exhibiting two distributions, or multi-modal, exhibiting more than one particle size distribution.

The minimum particle size for the smallest 5 percent of the nanoparticles may be less than 1 nm, specifically less than or equal to 0.8 nm, and more specifically less than or equal to 0.7 nm. Similarly, the maximum particle size for 95% of the nanoparticles is greater than or equal to 900 nm, specifically greater than or equal to 750 nm, and more specifically greater than or equal to 500 nm.

The nanoparticles have a high surface area of greater than 300 $m^2/g$, and in a specific embodiment, 300 $m^2/g$ to 1800 $m^2/g$, specifically 500 $m^2/g$ to 1500 $m^2/g$.

The nanoparticles disclosed herein comprise a fullerene, a nanotube, nanographite, nanographene, graphene fiber, nanodiamonds, polysilsesquioxanes, silica nanoparticles, nano clay, metal particles, ceramic particles, or a combination comprising at least one of the foregoing.

Fullerenes, as disclosed herein, may include any of the known cage-like hollow allotropic forms of carbon possessing a polyhedral structure. Fullerenes may include, for example, from about 20 to about 100 carbon atoms. For example, $C_{60}$ is a fullerene having 60 carbon atoms and high symmetry ($D_{5h}$), and is a relatively common, commercially available fullerene. Exemplary fullerenes may include $C_{30}$, $C_{32}$, $C_{34}$, $C_{38}$, $C_{40}$, $C_{42}$, $C_{44}$, $C_{46}$, $C_{48}$, $C_{50}$, $C_{52}$, $C_{60}$, $C_{70}$, $C_{76}$, and the like.

Nanotubes can include carbon nanotubes, inorganic nanotubes, metallated nanotubes, or a combination comprising at least one of the foregoing. Carbon nanotubes are tubular fullerene structures having open or closed ends, can be inorganic or made entirely or partially of carbon, and can include other components such as metals or metalloids. Nanotubes, including carbon nanotubes, can be single walled nanotubes (SWNTs) or multi-walled nanotubes (MWNTs).

Nanographite is a cluster of plate-like sheets of graphite, in which a stacked structure of one or more layers of graphite, which has a plate-like two dimensional structure of fused hexagonal rings with an extended delocalized π-electron system, are layered and weakly bonded to one another through π-π stacking interaction. Nanographite has both micro- and nano-scale dimensions, such as for example an average particle size of 1 to 20 μm, specifically 1 to 15 μm; and an average thickness (smallest) dimension in nano-scale dimensions of less than 1 μm, specifically less than or equal to 700 nm, and still more specifically less than or equal to 500 nm.

In an embodiment, the nanoparticle is a graphene including nanographene and graphene fibers (i.e., graphene particles having an average largest dimension of greater than 1 mm and an aspect ratio of greater than 10, where the graphene particles form an interbonded chain). Graphene and nanographene, as disclosed herein, are effectively two-dimensional particles of nominal thickness, having of one or more layers of fused hexagonal rings with an extended delocalized π-electron system, layered and weakly bonded to one another through π-π stacking interaction. Graphene in general, and including nanographene, may be a single sheet or a stack of several sheets having both micro- and nano-scale dimensions, such as in some embodiments an average particle size of 1 to 20 μm, specifically 1 to 15 μm, and an average thickness (smallest) dimension in nano-scale dimensions of less than or equal to 50 nm, specifically less than or equal to 25 nm, and more specifically less than or equal to 10 nm. An exemplary nanographene can have an average particle size of 1 to 5 μm, and specifically 2 to 4 μm. In addition, smaller nanoparticles or sub-micron sized particles as defined above may be combined with nanoparticles having an average particle size of greater than or equal to 1 μm. In a specific embodiment, the derivatized nanoparticle is a derivatized nanographene.

Graphene, including nanographene, may be prepared by exfoliation of nanographite or by a synthetic procedure by "unzipping" a nanotube to form a nanographene ribbon, followed by derivatization of the nanographene to prepare, for example, nanographene oxide.

Exfoliation to form graphene or nanographene may be carried out by exfoliation of a graphite source such as graphite, intercalated graphite, and nanographite. Exemplary exfoliation methods include, but are not limited to, those practiced in the art such as fluorination, acid intercalation, acid intercalation followed by thermal shock treatment, and the like, or a combination comprising at least one of the foregoing. Exfoliation of the nanographite provides a nanographene having fewer layers than non-exfoliated nanographite. It will be appreciated that exfoliation of nanographite may provide the nanographene as a single sheet only one molecule thick, or as a layered stack of relatively few sheets. In an embodiment, exfoliated nanographene has fewer than 50 single sheet layers, specifically fewer than 20 single sheet layers, specifically fewer than 10 single sheet layers, and more specifically fewer than 5 single sheet layers.

Polysilsesquioxanes, also referred to as polyorganosilsesquioxanes or polyhedral oligomeric silsesquioxanes (POSS) derivatives are polyorganosilicon oxide compounds of general formula $RSiO_{1.5}$ (where R is an organic group such as methyl) having defined closed or open cage structures (closo or nido structures). Polysilsesquioxanes, including POSS structures, may be prepared by acid and/or base-catalyzed condensation of functionalized silicon-containing monomers such as tetraalkoxysilanes including tetramethoxysilane and tetraethoxysilane, and alkyltrialkoxysilanes such as methyltrimethoxysilane and methyltrimethoxysilane.

Nanoclays can be used in the open cell foam. Nanoclays may be hydrated or anhydrous silicate minerals with a layered structure and may include, for example, alumino-silicate clays such as kaolins including halloysite, smectites including montmorillonite, illite, and the like. Exemplary nanoclays include those marketed under the tradename CLOISITE® marketed by Southern Clay Additives, Inc. Nanoclays can be exfoliated to separate individual sheets, can be non-exfoliated, and further, can be dehydrated or included as hydrated minerals. Other nano-sized mineral fillers of similar structure may also be included such as, for example, talc, micas including muscovite, phlogopite, or phengite, or the like.

Inorganic nanoparticles such as ceramic particles can also be included in the open cell foam. Exemplary inorganic nanoparticles may include a metal or metalloid carbide such as tungsten carbide, silicon carbide, boron carbide, or the like; a metal of metalloid oxide such as alumina, silica, titania, zirconia, or the like; a metal or metalloid nitride such as titanium nitride, boron nitride, silicon nitride, or the like; and/or a metal nanoparticle such as iron, tin, titanium, platinum, palladium, cobalt, nickel, vanadium, alloys thereof, or a combination comprising at least one of the foregoing.

A nanodiamond is a diamond particle having an average particle size of less than 1 μm. Nanodiamonds are from a naturally occurring source, such as a by-product of milling or other processing of natural diamonds, or are synthetic and are prepared by any suitable method such as commercial methods involving detonation synthesis of nitrogen-containing carbon compounds (e.g., a combination of trinitrotoluene (TNT) and cyclotrimethylenetrinitramine (RDX)).

The nanoparticles used herein can be derivatized to include functional groups such as, for example, carboxy (e.g., carboxylic acid groups), epoxy, ether, ketone, amine, hydroxy, alkoxy, alkyl, aryl, aralkyl, alkaryl, lactone, functionalized polymeric or oligomeric groups, or a combination comprising at least one of the forgoing functional groups. Such functional groups can be ionic. In a non-limiting embodiment, the nanoparticles are a combination of non-derivatized nanoparticles and nanoparticles derivatized with a carboxylic acid group, wherein some of the functional groups are de-protonated as a carboxylate group. The nanoparticles, including nanographene after exfoliation, are derivatized to introduce chemical functionality to the nanoparticle. For example, for nanographene, the surface and/or edges of the nanographene sheet is derivatized to increase dispersibility in and interaction with the polymer matrix. In an embodiment, the derivatized nanoparticle may be hydrophilic, hydrophobic, oleophilic, olephobic, oxophilic, lipophilic, or may possess a combination of these properties to provide a balance of desirable net properties, by use of different functional groups.

In an embodiment, the nanoparticle is derivatized by, for example, amination to include amine groups, where amination may be accomplished by nitration followed by reduction, or by nucleophilic substitution of a leaving group by an amine, substituted amine, or protected amine, followed by deprotection as necessary. In another embodiment, the nanographene can be derivatized by oxidative methods to produce an epoxy, hydroxy group or glycol group using a peroxide, or by cleavage of a double bond by, for example, a metal mediated oxidation such as a permanganate oxidation to form ketone, aldehyde, or carboxylic acid functional groups.

Where the functional groups for the derivatized nanoparticles are alkyl, aryl, aralkyl, alkaryl, functionalized polymeric or oligomeric groups, or a combination of these groups, the functional groups can be attached (a) directly to the derivatized nanoparticle by a carbon-carbon bond without intervening heteroatoms, to provide greater thermal and/or chemical stability to the derivatized nanoparticle as well as a more efficient synthetic process requiring fewer steps; (b) by a carbon-oxygen bond (where the nanoparticle contains an oxygen-containing functional group such as hydroxy or carboxylic acid); or (c) by a carbon-nitrogen bond (where the nanoparticle contains a nitrogen-containing functional group such as amine or amide). In an embodiment, the nanoparticle can be derivatized by a metal mediated reaction with a $C_{6-30}$ aryl or $C_{7-30}$ aralkyl halide (F, Cl, Br, I) in a carbon-carbon bond forming step, such as by a palladium-mediated reaction such as the Stille reaction, Suzuki coupling, or diazo coupling, or by an organocopper coupling reaction. In another embodiment, a nanoparticle, such as a fullerene, nanotube, nanodiamond, or nanographene, may be directly metallated by reaction with, e.g., an alkali metal such as lithium, sodium, or potassium, followed by reaction with a $C_{1-30}$ alkyl or $C_{7-30}$ alkaryl compound with a leaving group such as a halide (Cl, Br, I) or other leaving group (e.g., tosylate, mesylate, etc.) in a carbon-carbon bond forming step. The aryl or aralkyl halide, or the alkyl or alkaryl compound, may be substituted with a functional group such as hydroxy, carboxy, ether, or the like. Exemplary groups include, for example, hydroxy groups, carboxylic acid groups, alkyl groups such as methyl, ethyl, propyl, butyl, pentyl, hexyl, octyl, dodecyl, octadecyl, and the like; aryl groups including phenyl and hydroxyphenyl; aralkyl groups such as benzyl groups attached via the aryl portion, such as in a 4-methylphenyl, 4-hydroxymethylphenyl, or 4-(2-hydroxyethyl)phenyl (also referred to as a phenethylalcohol) group, or the like, or aralkyl groups attached at the benzylic (alkyl) position such as found in a phenylmethyl or 4-hydroxyphenyl methyl group, at the 2-position in a phenethyl or 4-hydroxyphenethyl group, or the like. In an exemplary embodiment, the derivatized nanoparticle is nanographene substituted with a benzyl, 4-hydroxybenzyl, phenethyl, 4-hydroxyphenethyl, 4-hydroxymethylphenyl, or 4-(2-hydroxyethyl)phenyl group or a combination comprising at least one of the foregoing groups.

In another embodiment, the nanoparticle can be further derivatized by grafting certain polymer chains to the functional groups. For example, polymer chains such as acrylic chains having carboxylic acid functional groups, hydroxy functional groups, and/or amine functional groups; polyamines such as polyethyleneamine or polyethyleneimine; and poly(alkylene glycols) such as poly(ethylene glycol) and poly(propylene glycol), may be included by reaction with functional groups.

The functional groups of the derivatized nanoparticle may react directly with other components in the open cell foam, including reactive functional groups that may be present in the polyurethane, other polymers (if present), or monomeric constituents, leading to improved tethering/reaction of the derivatized nanoparticle with the polymeric matrix. Where the nanoparticle is a carbon-based nanoparticle such as nanographene, a carbon nanotube, nanodiamond, or the like, the degree of derivatization for the nanoparticles can vary from 1 functional group for every 5 carbon centers to 1 functional group for every 100 carbon centers, depending on the functional group.

In an embodiment, in addition to the nanoparticles, the open cell foam can include filler particles such as carbon black, mica, clays such as e.g., montmorillonite clays, silicates, glass fiber, carbon fiber, and the like, and combinations comprising at least one of the foregoing fillers.

According to an embodiment, the open cell foam herein can include a surfactant to stabilize the nanoparticles. Useful surfactants include fatty acids of up to 22 carbon atoms such as stearic acids and esters and polyesters thereof, poly(alkylene glycols) such as poly(ethylene oxide), poly(propylene oxide), and block and random poly(ethylene oxide-propylene oxide) copolymers such as those marketed under the PLURONIC™ tradename by BASF. Other surfactants include polysiloxanes, such as homopolymers and copolymers of poly(dimethylsiloxane), including those having functionalized end groups, and the like. Other useful surfactants include those having a polymeric dispersant having poly(alkylene glycol) side chains, fatty acids, or fluorinated groups such as perfluorinated $C_{1-4}$ sulfonic acids grafted to the polymer backbone. Polymer backbones include those based on a polyester, a poly(meth)acrylate, a polystyrene, a poly(styrene-(meth)acrylate), a polycarbonate, a polyamide, a polyimide, a polyurethane, a polyvinyl alcohol, or a copolymer comprising at least one of these polymeric backbones. Additionally, the surfactant can be anionic, cationic, zwitterionic, or nonionic. The surfactant can be present in the foam in an amount from about 0.05 wt. % to about 10 wt. %, specifically about 0.1 wt. % to about 10 wt. %, and more specifically about 1 wt. % to about 5 wt. %, based on the weight of the foam.

Exemplary anionic surfactants include but are not limited to alkyl sulfates, alkyl sulfonates, alkyl benzene sulfates, alkyl benzene sulfonates, fatty acids, sulfosuccinates, and phosphates. Exemplary cationic surfactants include but quaternary ammonium salts and alkylated pyridinium salts. Examples of nonionic surfactants include alkyl primary, secondary, and tertiary amines, alkanolamides, ethoxylated fatty alcohols, alkyl phenol polyethoxylates, fatty acid esters, glycerol esters, glycol esters, polyethers, alkyl polyglycosides, and amineoxides. Zwitterionic surfactants (which include a cationic and anionic functional group on the same molecule) include, for example, betaines, such as alkyl ammonium carboxylates (e.g., $[(CH_3)_3N^+—CH(R)COO^-]$ or sulfonates (sulfo-betaines) such as $[RN^+(CH_3)_2(CH_2)_3SO_3—]$). Examples include n-dodecyl-N-benzyl-N-methylglycine $[C_{12}H_{25}N^+(CH_2C_6H_5)(CH_3)CH_2COO^-]$, N-allyl N-benzyl N-methyltaurines $[C_nH_{2n+1}N^+(CH_2C_6H_5)(CH_3)CH_2CH_2SO_3^-]$.

In an embodiment, the open cell foam includes (in addition to the base polymer polyurethane) an additional polymer to obtain mechanical and/or chemical properties effective for use of the open cell foam downhole, i.e., the additional polymer may be any polymer useful for forming a nanocomposite for downhole applications. The additional polymer can provide a hydrophobic or hydrophilic property to the open cell foam as well as providing elasticity or rigidity at a certain temperature. For example, the polymer may comprise a fluoroelastomer, perfluoroelastomer, hydrogenated nitrile butyl rubber, ethylene-propylene-diene monomer (EPDM) rubber, silicone, epoxy, polyetheretherketone, bismaleimide, polyethylene, polyvinyl alcohol, phenolic resin, nylon, polycarbonate, polyester, polyphenylene sulfide, polyphenylsulfone, tetrafluoroethylene-propylene elastomeric copolymer, or a combination comprising at least one of the foregoing polymers.

Exemplary polymers include phenolic resins such as those prepared from phenol, resorcinol, o-, m- and p-xylenol, o-, m-, or p-cresol, and the like, and aldehydes such as formaldehyde, acetaldehyde, propionaldehyde, butyraldehyde, hexanal, octanal, dodecanal, benzaldehyde, salicylaldehyde, where exemplary phenolic resins include phenol-formaldehyde resins; epoxy resins such as those prepared from bisphenol A diepoxide, polyether ether ketones (PEEK), bismaleimides (BMI), nylons such as nylon-6 and nylon 6,6, polycarbonates such as bisphenol A polycarbonate, nitrile-butyl rubber (NBR), hydrogenated nitrile-butyl rubber (HNBR); high fluorine content fluoroelastomers rubbers such as ethylene tetrafluoroethylene (ETFE, available under the tradename Teflon® ETFE), fluorinated ethylene propylene (FEP, available under the tradename Teflon® FEP from DuPont), perfluoroalkoxy (PFA, available under the tradename Teflon® PFA from DuPont), polyvinylidene fluoride (PVDF, available under the tradename Hylar from Solvay Solexis S.p.A.), ethylene chlorotrifluoroethylene (ECTFE, available under the tradename Halar ECTFE from Solvay Solexis S.p.A.), and those in the FKM family and marketed under the tradename VITON® (available from FKM-Industries); and perfluoroelastomers such as polytetrafluoroethylene (PTFE, available under the tradename Teflon® from DuPont), FFKM (also available from FKM-Industries) and also marketed under the tradename KALREZ® perfluoroelastomers (available from DuPont), and VECTOR® adhesives (available from Dexco LP); organopolysiloxanes such as functionalized or unfunctionalized polydimethylsiloxanes (PDMS); tetrafluoroethylene-propylene elastomeric copolymers such as those marketed under the tradename AFLAS® and marketed by Asahi Glass Co.; ethylene-propylene-diene monomer (EPDM) rubbers; polyethylene; polyvinylalcohol (PVA); and the like. Combinations of these polymers may also be used.

In an embodiment, the open cell foam having a base polymer of polyurethane is formed by combining, for example, a diisocyanate and diol described above. A blowing agent can be included to produce the pores for the open cell foam (as discussed below, the open cells of the foam are created by inclusion of nanoparticles with the reactive monomers used to produce the base polymer polyurethane). According to an embodiment, a blowing agent such as water is included with the diol to provide a foam structure due to generation of carbon dioxide from the reaction between diisocyanate and water when the diisocyanate is combined with the water and diol. Alternatively the foam can be formed by other chemical or physical blowing agents. Examples of the blowing agent include hydrochlorofluorocarbons (e.g., methylene chloride, tetrafluoroethylene, pentafluoropropane, heptafluoropropane, pentafluorobutane, hexafluorobutane, and dichloromonofluoroethane), hydrocarbons (for example, pentane, isopentane, and cyclopentane), carbon dioxide, acetone, and water In a further embodiment, the pores for the open cell foam can be produced by placing the above components in a vacuum chamber and decreasing the pressure below the internal pressure of the forming polyurethane to cause out-gassing of the polymer material.

The density of the foam can be controlled by the amount of water or blowing agent added. The amount of water can be about 0.5 weight percent (wt. %) to about 5.0 wt. %, specifically about 0.5 wt. % to about 4.0 wt. %, and more specifically about 0.5 wt. % to about 3.0 wt. %, based on the weight of the diol (or polyol). Alternatively or additionally, physical blowing agents can be used in amount about 0.5 wt. % to about 15 wt. %, and specifically about 0.5 wt. % to about 10 wt. %, based on the combined weight of the diol (or polyol) and diisocyanate (or polyisocyanate). In an embodiment, physical blowing agents, such as carbon dioxide, can be used in combination with water as a blowing agent.

The nanoparticles may be formulated as a solution or dispersion and cast or coated, or may be mechanically dispersed in a polymer resin matrix. Blending and dispersion of the nanoparticles and the polymer resin may be accomplished by methods such as, for example, extrusion, high shear mixing, rotational mixing, three roll milling, and the like.

Mixing the nanoparticle, which can be derivatized, with a reactive monomer of the base polymer can be accomplished by rotational mixing, or by a reactive injection molding-type process using two or more continuous feed streams, in which the nanoparticles may be included as a component of one of the feed streams (e.g., in polyurethane preparation using different feed streams, the nanoparticles are included in the diisocyanate or polyol, diamine, etc. streams, or in a separate stream as a suspension in a solvent). Mixing in such continuous feed systems is accomplished by the flow within the mixing zone at the point of introduction of the components. The nanoparticles can be mixed with the reactive monomers prior to a two-fold increase in the viscosity of the reactive monomer mixture (i.e., diol and diisocyanate mixture, for example), where including the nanoparticles prior to the increase in viscosity ensures uniform dispersion of the nanoparticles.

The properties of the open cell foam can be adjusted by the selection of the nanoparticles; for example, plate-like derivatized nanographene may be arranged or assembled with the base polymer by taking advantage of the intrinsic surface properties of the nanographene after exfoliation, in addition to the functional groups introduced by derivatization.

In the open cell foam, nanoparticles can be present in an amount of about 0.01 wt. % to about 30 wt. %, specifically about 0.05 wt. % to about 27 wt. %, more specifically about 0.1 wt. % to about 25 wt. %, even more specifically about 0.25 wt. % to about 22 wt. %, and still more specifically about 0.5 wt. % to about 20 wt. %, based on the total weight of the open cell foam.

In a specific embodiment, the open cell foam includes a polyurethane resin, and 0.05 wt. % to 20 wt. % of a nanoparticle based on the total weight of the open cell foam. In another specific embodiment, the open cell foam includes a polyurethane resin, and 0.05 to 20 wt. % of a derivatized nanodiamond based on the total weight of the open cell foam, the derivatized nanodiamond including functional groups comprising carboxy, epoxy, ether, ketone, amine, hydroxy, alkoxy, alkyl, aryl, aralkyl, alkaryl, lactone, functionalized polymeric or oligomeric groups, or a combination comprising at least one of the forgoing functional groups.

The polyurethane and derivatized nanoparticles can be formed into a dispersion to facilitate processing. The solvent may be an inorganic solvent such as water, including deionized water, or buffered or pH adjusted water, mineral acid, or a combination comprising at least one of the foregoing, or an organic solvent comprising an alkane, alcohol, ketone, oils, ethers, amides, sulfones, sulfoxides, or a combination comprising at least one of the foregoing.

Exemplary inorganic solvents include water, sulfuric acid, hydrochloric acid, or the like; exemplary oils include mineral oil, silicone oil, or the like; and exemplary organic solvents include alkanes such as hexane, heptane, 2,2,4-trimethylpentane, n-octane, cyclohexane, and the like; alcohols such as methanol, ethanol, propanol, isopropanol, butanol, t-butanol, octanol, cyclohexanol, ethylene glycol, ethylene glycol methyl ether, ethylene glycol ethyl ether, ethylene glycol butyl ether, propylene glycol, propylene glycol methyl ether, propylene glycol ethyl ether, and the like; ketones such as acetone, methyl-ethyl ketone, cyclohexanone methyletherketone, 2-heptanone, and the like; esters such as ethyl acetate, propylene glycol methyl ether acetate, ethyl lactate, and the like; ethers such as tetrahydrofuran, dioxane, and the like; polar aprotic solvents such as N,N-dimethylformamide, N-methylcaprolactam, N-methylpyrrolidine, dimethylsulfoxide, gamma-butyrolactone, or the like; or a combination comprising at least one of the foregoing.

The polyurethane, derivatized nanoparticles, and any solvent may be combined by extrusion, high shear mixing, three-roll mixing, rotational mixing, or solution mixing. In an embodiment, the dispersion may be combined and mixed in a rotational mixer. In this manner, the nanoparticles are uniformly distributed among the polyurethane chains in the open cell foam.

According to an embodiment, the composition containing the reactive monomers and nanoparticles are mixed for about 20 seconds and then disposed in a mold, which is immediately closed by placing a top metal plate on the mold. Due to the significant amount of pressure generated by the foam-forming process, a clamp can be used to hold the top metal plate and mold together to prevent leakage of the foam material from the mold. After about 2 hours, the polyurethane foam material is sufficiently cured such that it can be removed from the mold, i.e., de-molded. Thereafter, in one specific embodiment, the polyurethane foam material is post-cure treated at a temperature of about 100° C. for about 6 hours so that the polyurethane foam material reaches its full strength. Thus in an embodiment, a method of preparing an open cell foam includes combining a diisocyante and diol to form a polymer composition; introducing nanoparticles to the polymer composition; and foaming the polymer composition to produce the open cell foam having nanoparticles exposed within pores of the open cell foam. Here, the nanoparticles can be derivatized with functional groups. In another non-restrictive embodiment, the polymer composition is introduced into a mold prior to curing, cured in a mold; and de-molded to produce a downhole filter comprising the open cell foam.

The polyurethane foam material may have a layer of "skin" on the outside surface of the polyurethane foam. The skin is a layer of solid polyurethane elastomer formed when the mixture containing reactive monomers contacts the mold surface. The thickness of the skin can depend on the concentration of water added to the mixture. Excess water content decreases the thickness of the skin and insufficient water content increases the thickness of the skin. The formation of the skin is believed to be due to the reaction between the isocyanate in the mixture and the moisture on the mold surface. Therefore, additional mechanical conversion processes can be used to remove the skin. Tools such as band saws, miter saws, hack saws, and hot wire filament saws can be used to remove the skin. After removing the skin from the polyurethane foam material, it will have a full open cell structure, excellent elasticity, and very good tear strength.

With regard to the open cells of the foam, without wishing to be bound by theory, it is believed that as gas bubbles are created within the forming polyurethane matrix (either by accumulation of the blowing agent or reaction product carbon dioxide, if present). Defects at the interface of the liquid polyurethane and the gas are produced by the nanoparticles, particularly in the case of derivatized nanoparticles. The defects lower the stability of the bubble formations. These defect sites allow neighboring bubbles to interconnect via channels in the foam without bulk coalescence of large bubble aggregates. Ultimately, a network of interconnected bubbles will be joined to produce an open cell foam as the polyurethane is cured. In an embodiment, since the nanoparticles serve as defect sites that create the open cell structure of the foam, the nanoparticles are disposed not only throughout the polyurethane matrix but also are exposed in the pores of the open cell foam. According to an embodiment, the nanoparticles are uniformly dispersed among chains of the polyurethane within the open cell foam such that a portion of the nanoparticles is unexposed within the pores while a portion of the nanoparticles are exposed in the pores. The interconnected pores (open cells) of the foam form flow paths through the open cell foam.

Figure 5:
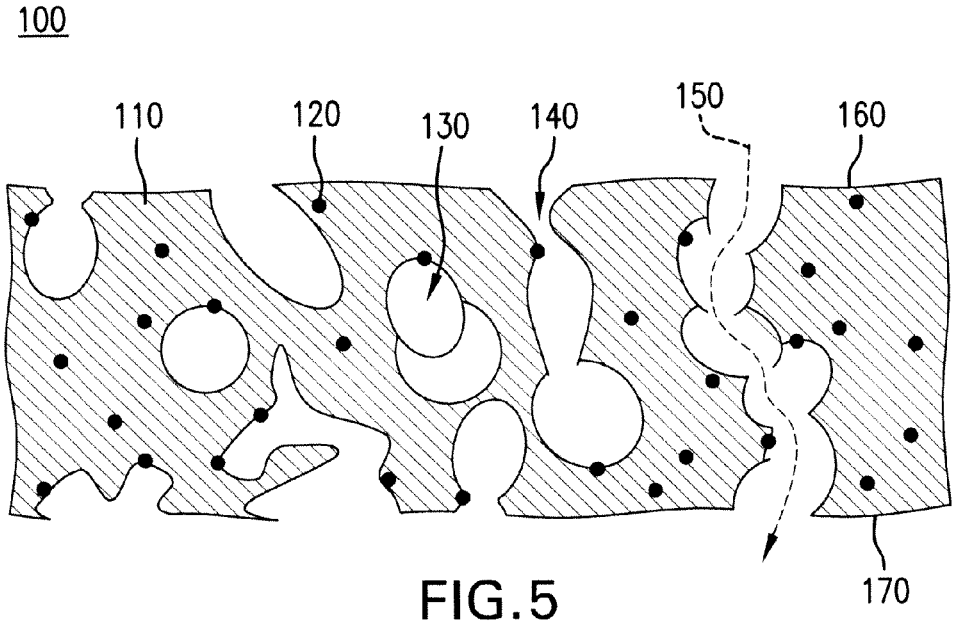
FIG. 5 shows a cross-section of an open cell foam.

FIG. 5 shows a cross-section of an open cell foam 100. The open cell foam 100 includes a polyurethane matrix 110 and nanoparticles 120 distributed throughout the polyurethane 110 and exposed by pores 130 that are interconnected by flow channels 140. Although the cross-section shown in FIG. 5 only has a limited number of pores 130 that interconnect, the open cell foam 100 includes a network of interconnected pores 130 that establish numerous flow paths 150 (represented by the dotted curve with an arrow indicating flow direction) across the open cell foam 100 from a first surface 160 to a second surface 170.

According to an embodiment, the size of the pores of the open cell foam is determined by the particle size of the nanoparticles. As used herein, "size of the pores" refers to the largest particle that can be accommodated by the pore. In a non-limiting embodiment, the size of the pores is about 75 μm to about 1000 μm, more specifically about 75 μm to about 850 μm, and more specifically about 75 μm to about 500 μm. Thus, the open cell foam filters particles due to size. In an embodiment, the open cell foam excludes traversal across the open cell foam of particles having a size of greater than 1000 μm, more specifically greater than 500 μm, and more specifically greater than about 50 μm. In another embodiment, the open cell foam allows traversal across the open cell foam of particles having a size of less than or equal to 1000 μm, more specifically less than or equal to 500 μm, even more specifically less than or equal to 100 μm, and even more specifically less than or equal to 0.5 μm.

In an embodiment, the flow rate of fluid across the open cell foam is determined by functional groups attached to the nanoparticles. It will be appreciated that the flow rate is a function of other parameters such as the pore size, geometry of flow paths (which can include linear paths as well as curved paths), liquid viscosity, and the like. In a non-limiting embodiment, the flow rate of fluid through the open cell foam is about 0.5 liter per minute (LPM) to about 7500 LPM, specifically about 1 LPM to about 6000 LPM, more specifically about 1 LPM to about 5000 LPM, and even more specifically about 1 LPM to about 2500 LPM. In particular, the pores of the open cell foam selectively transmit fluids but block flow of particles. Due to the pore density of the open cell foam, even though particles may block certain flow paths through the open cell foam, the flow rate of the open cell foam is maintained at a high value.

With respect to fluid absorption, the functional groups of the derivatized nanoparticles mediate the fluid absorption behavior of the open cell foam. In an embodiment, the nanoparticles, exposed in the pores of the open cell foam, are derivatized with functional groups to selectively transmit non-polar fluids but selectively inhibit transmission of polar fluids through the open cell foam. In a further embodiment, the nanoparticles, exposed in the pores of the open cell foam, are derivatized with functional groups to selectively transmit polar fluids through the downhole filter and selectively inhibit transmission of non-polar fluids through the downhole filter. Although polar and non-polar fluids are specifically mentioned, it will be appreciated that the functional groups of the nanoparticles provide the nanoparticle with surface properties such that the nanoparticles are hydrophilic, hydrophobic, olepholic, olephobic, oxophilic, lipophilic, or a combination of these properties. Thus, the functional groups on the nanoparticles control the selective absorption and transmission of fluids based on these properties. By way of a non-restrictive embodiment, the nanoparticles are hydrophilic and allow flow of aqueous fluids through the open cell foam while inhibiting flow of hydrocarbons.

Figure 6A:
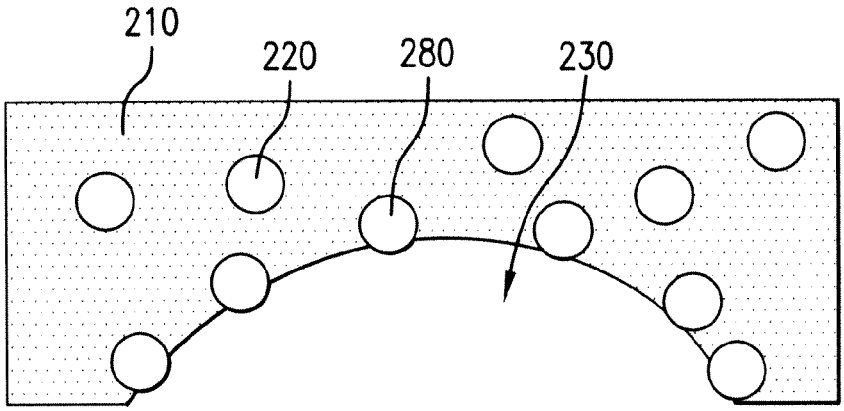
FIGS. 6A-6C show cross-sections of open cell foams having nanoparticles therein.
Figure 6B:
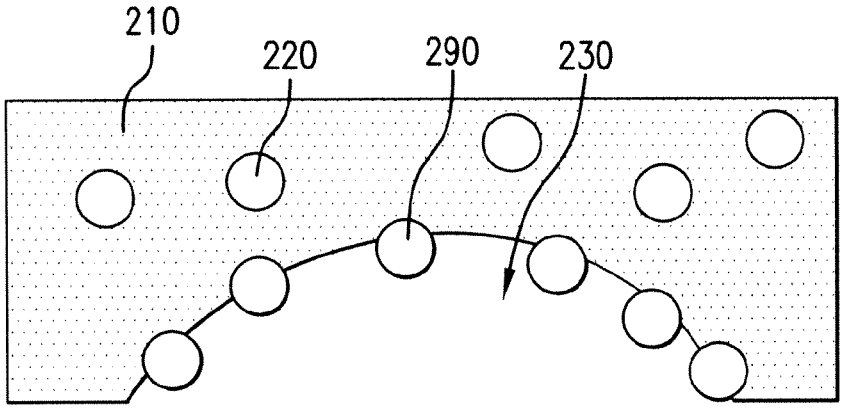
Figure 6C:
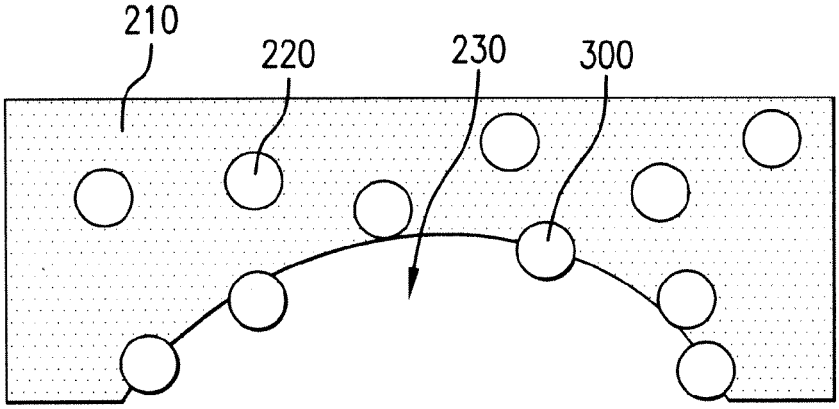

FIGS. 6A-6C show the effect of derivatization on the exposure of the nanoparticle within the pores of the open cell foam. Variation of the amount of exposure of the nanoparticles within the pores can affect the size of the pores and selectivity of the pores for fluid absorption and particulate matter filtration. FIG. 6A shows derivatized nanoparticles 220 among polyurethane 210 and derivatized nanoparticles 280 exposed within a pore 230 of an open cell foam. Here, the derivatized nanoparticles 280 are exposed to a small extent, for example, only 20% of the total surface area of the nanoparticle 280 may be present within the pore 230. FIG. 6B shows derivatized nanoparticles 290 that are exposed to a greater extent, for example, 80% of the total surface area of the nanoparticle 290 may be present within the pore 230. FIG. 6C shows a case where derivatized nanoparticles 300 are distributed such that, on average, 50% of the surface area of the nanoparticles 300 is exposed in the pores 230. The relative exposure of the nanoparticles within the pores of the open cell foam can be determined by selection of the functional group attached to the derivatized nanoparticles. When the functional groups interact strongly with the polyurethane matrix, a smaller amount of the surface area of the nanoparticles are exposed within the pores as compared with embodiments where the functional groups interact less strongly with the polyurethane matrix so that a greater amount of the surface area of the nanoparticles are exposed within the pores of the open cell foam. It is believed that the flow rate of a particular fluid through the open cell foam depends on the absolute number of nanoparticles exposed in the pores of the open cell foam as well as the amount of the surface area exposed in the pores. Due to the interaction time of the fluid with the nanoparticles within the pores, the flow rate can vary. Consequently, a highly effective and selective fluid and particle filter is constructed from the open cell foam.

Thus, in an embodiment, a downhole filter comprises the open cell foam and nanoparticles disposed in the open cell foam and exposed within the pores of the open cell foam. Such a downhole filter can be a sandscreen or other article for filtering particles and/or separating fluids (including gas, liquids, or a combination comprising one of the foregoing).

While one or more embodiments have been shown and described, modifications and substitutions may be made thereto without departing from the spirit and scope of the invention. Accordingly, it is to be understood that the present invention has been described by way of illustrations and not limitation.

All ranges disclosed herein are inclusive of the endpoints, and the endpoints are independently combinable with each other. The suffix "(s)" as used herein is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like. All references are incorporated herein by reference.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A downhole fluid separation assembly, comprising:

a body having one or more first portions configured to have first affinity to a first fluid and one or more second portions configured to have a second affinity to a second fluid, the body operatively arranged with openings for enabling fluid flow therethrough; and a member movable with respect to the body and operatively arranged to compress a section of the body adjacent to the member for urging fluid out of the body and toward a target location, the body configured to expand when not adjacent to the member for enabling fluid to reenter the body.

2. The assembly of claim 1, wherein the member facilitates fluid movement in a desired direction.

3. The assembly of claim 1, wherein the member facilitates movement of the first fluid through at least one of the first portions in a first direction and movement of the second fluid through at least one of the second portions in a second direction, the second direction being different from the first direction.

4. The assembly of claim 3, wherein the member pumps the first fluid to a surface location and pumps the second fluid back downhole into a formation.

5. The assembly of claim 1, wherein the arrangement further includes at least one seal element disposed with the body, the seal element selectively sealing fluid flow through the one or more first or second portions in at least one direction.

6. The assembly of claim 5, wherein the seal element is disposed between one or more of the first portions from one or more of the second portions to impede fluid communication therebetween.

7. The assembly of claim 5, wherein the seal element is disposed at at least one end of the body for impeding fluid flow through at least one of the first or second portions in at least one direction.

8. The assembly of claim 1, wherein the body comprises open cell foam.

9. The assembly of claim 8, wherein the open cell foam includes nanoparticles disposed therein and exposed within pores of the open cell foam.

10. The assembly of claim 9, wherein the nanoparticles determine the affinity of the body for at least one of the first fluid or the second fluid.

11. The assembly of claim 10, wherein the nanoparticles are derivatized with functional groups to selectively transmit polar fluids, non-polar fluids, or combinations including at least one of the foregoing through the body.

12. The assembly of claim 1, wherein a shroud is positioned with the body for enabling compression of the body by the member thereagainst.

13. The assembly of claim 12, wherein the body is positioned on opposite radial sides of the shroud for enabling engagement of the body with a downhole structure.

14. The assembly of claim 1, wherein the body is operatively arranged to expand for filling an annulus in which the assembly is placed.

15. The assembly of claim 14, wherein the openings in the body are operatively sized for filtering solids from the first and second fluids while enabling fluid flow therethrough.

16. The assembly of claim 1, wherein the first fluid experiences capillary action in the body.

17. A downhole fluid separation assembly, comprising:

a body having greater affinity to a first fluid than a second fluid, the body operatively arranged with openings for enabling fluid flow therethrough;

a member movable with respect to the body and operatively arranged to compress a section of the body adjacent to the member for urging fluid out of the body and towards a target location, the body configured to expand when not adjacent to the member for enabling fluid to reenter the body; and a support in operable arrangement with the member for creating a void within the body, the support having openings therein for enabling fluid communication between the void and the body, the void being in fluid communication with the target location.

18. A downhole fluid separation assembly, comprising:

a body having greater affinity to a first fluid than a second fluid, the body operatively arranged with openings for enabling the first fluid to flow therethrough; and a member movable with respect to the body and operatively arranged to compress a section of the body adjacent to the member for urging the first fluid out of the body in a first direction toward a target location without urging the second fluid in the first direction toward the target location, the body configured to expand when not adjacent to the member for enabling the first fluid to reenter the body.

19. The assembly of claim 18, wherein the first direction is toward a surface of an oil well.

* * * * *